United States Patent [19]

Hollands

[11] Patent Number: 4,742,460

[45] Date of Patent: May 3, 1988

[54] VEHICLE PROTECTION SYSTEM

[75] Inventor: Roger D. Hollands, Chippenham, England

[73] Assignee: Westinghouse Brake and Signal Company Ltd., United Kingdom

[21] Appl. No.: 736,210

[22] Filed: May 20, 1985

[30] Foreign Application Priority Data

May 24, 1984 [GB] United Kingdom ..... 8413324

[51] Int. Cl.[4] ..... B61L 3/00

[52] U.S. Cl. ..... 364/424; 246/34 R; 246/167 R

[58] Field of Search ..... 364/424, 426, 484, 550, 364/551; 246/2 F, 2 S, 28 R, 34 R, 34 B, 167 R

[56] References Cited

U.S. PATENT DOCUMENTS

| | | | |
|---|---|---|---|
| 3,526,378 | 9/1970 | Thorne-Booth | 246/34 R |
| 3,958,781 | 5/1976 | Woods et al. | 246/34 R |
| 4,349,170 | 9/1982 | Bilet et al. | 246/34 R |
| 4,352,475 | 10/1982 | Smith et al. | 246/34 R |
| 4,420,133 | 12/1983 | Dietrich | 246/167 R |
| 4,516,249 | 5/1985 | Cook et al. | 246/34 R |

*Primary Examiner*—Gary Chin

*Attorney, Agent, or Firm*—Nilsson, Robbins, Dalgarn, Berliner, Carson & Wurst

[57] ABSTRACT

An automatic vehicle protection system, e.g. for a railway vehicle, in which continuous contact is maintained with a train via transmissions carried by the normal track circuit signals. Information relayed to the train through these transmissions may concern speed limits, forward section occupancy and so on which can replace normal track side visual signalling systems as a means of controlling trains. It is, therefore of utmost importance to ensure that a train receives the correct transmission, which it is intended to receive, and not those meant for other trains. By arranging for track circuit signal freqencies in predetermined sequences and providing the train with means for determining whether or not the sequence of frequencies it encounters as it traverses a line the safety of the train, and the integrity of the system may be continuously proved. In the event that the train encounters an invalid frequency sequence the emergency brakes may be brought into action, alternatively the train may be permitted to continue but at a reduced speed.

13 Claims, 6 Drawing Sheets

FOR A CARRIER TO BE IN CORRECT SEQUENCE :

| PREVIOUS NEW OPERATE CARRIER | ACCEPTABLE RECEIVED CARRIER |
|---|---|
| F1 OR F4 | F1, F3, OR F4 |
| F2 OR F5 | F2, F3, OR F4 |

NOTE F3 RECEIVED INDICATES A TRANSITION FROM F1, F4, SEQUENCE TO F2, F5, SEQUENCE CAN BE ALLOWED

CARRIER PAIRS ARE DEFINED AS FOLLOWS

| PREVIOUS NEW OPERATE CARRIER | UNACCEPTABLE RECEIVED CARRIER PAIR |
|---|---|
| F1 OR F4 | F2 + F5 |
| F2 OR F5 | F1 + F4 |

ASSOCIATED CARRIERS ARE DEFINED AS FOLLOWS

| PREVIOUS NEW OPERATE CARRIER | ASSOCIATE |
|---|---|
| F1 | F4 |
| F4 | F1 |
| F2 | F5 |
| F5 | F2 |

VEHICLE PROTECTION SYSTEM

The invention concerns a vehicle protection system. It is particularly useful in connection with automatic protection of railway vehicles especially those with which communication is maintained through the transmission, for example, of track circuit signals.

In a system of the type referred to the vehicle is provided with a safety system, such as an emergency brake, which is brought into operation automatically when an unsafe situation is detected by control means carried on the vehicle. This may happen, for example, if the control means ceases to receive a track circuit signal, or receives more than one signal in circumstances which may cause ambiguity.

Problems can also arise in such arrangements due to "cross-talk" and leakage between adjacent tracks which may lead to a signal being carried by a "wrong" road or track and its possible misinterpretation by a vehicle as a valid signal.

According to the invention there is provided a vehicle protection system for vehicles confined to move along fixed pathways in which the pathways are effectively sub-divided into sections and communication with a vehicle is established by transmission of a signal the frequency of which changes between adjacent sections according to a predetermined sequence of frequencies in each pathway, and intermediate sections are provided at intersections and crossings in which the signal has a further frequency, a vehicle is provided with a signal receiver, and control means responsive to the received signal frequency sequence to perform a safety function in the event that the received sequence is not a valid sequence. The control means is preferably further responsive to a received intermediate section frequency to prepare to receive a fresh signal frequency sequence.

Figure 1:
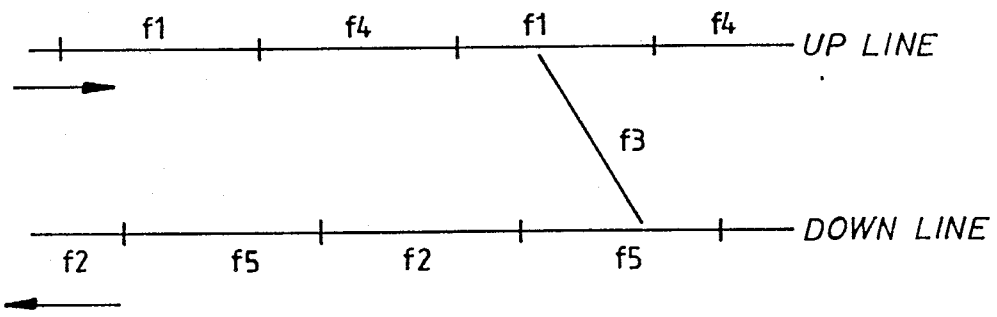
Figure 2:
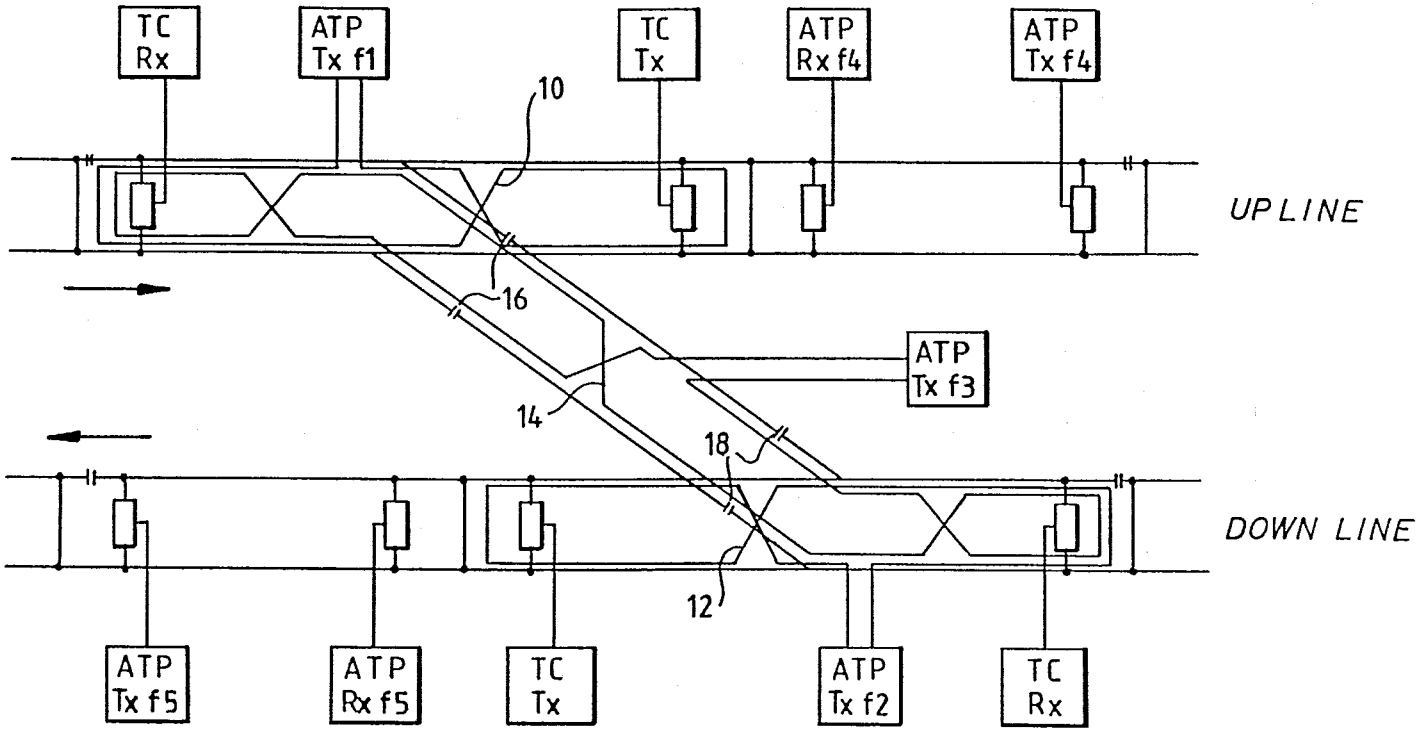
Figure 3A:
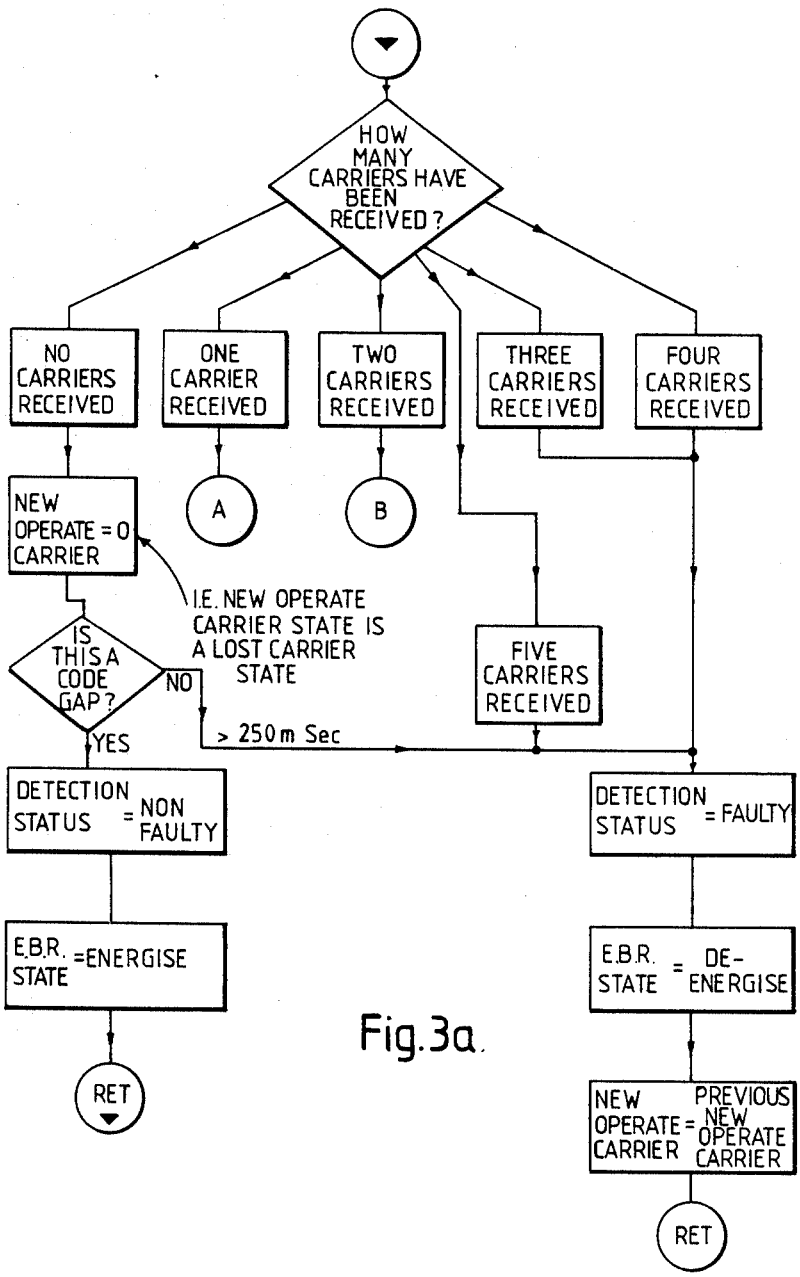
Figure 3B:
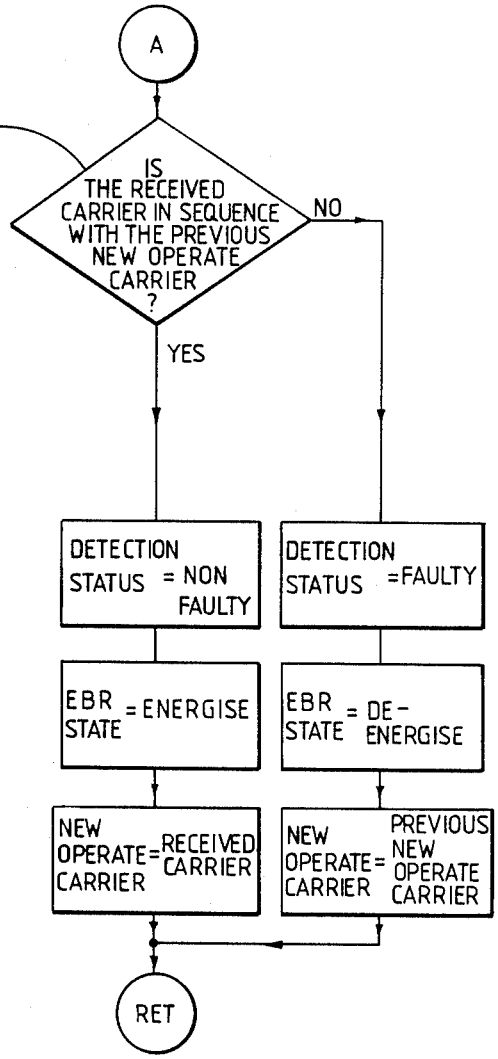
Figure 3C:
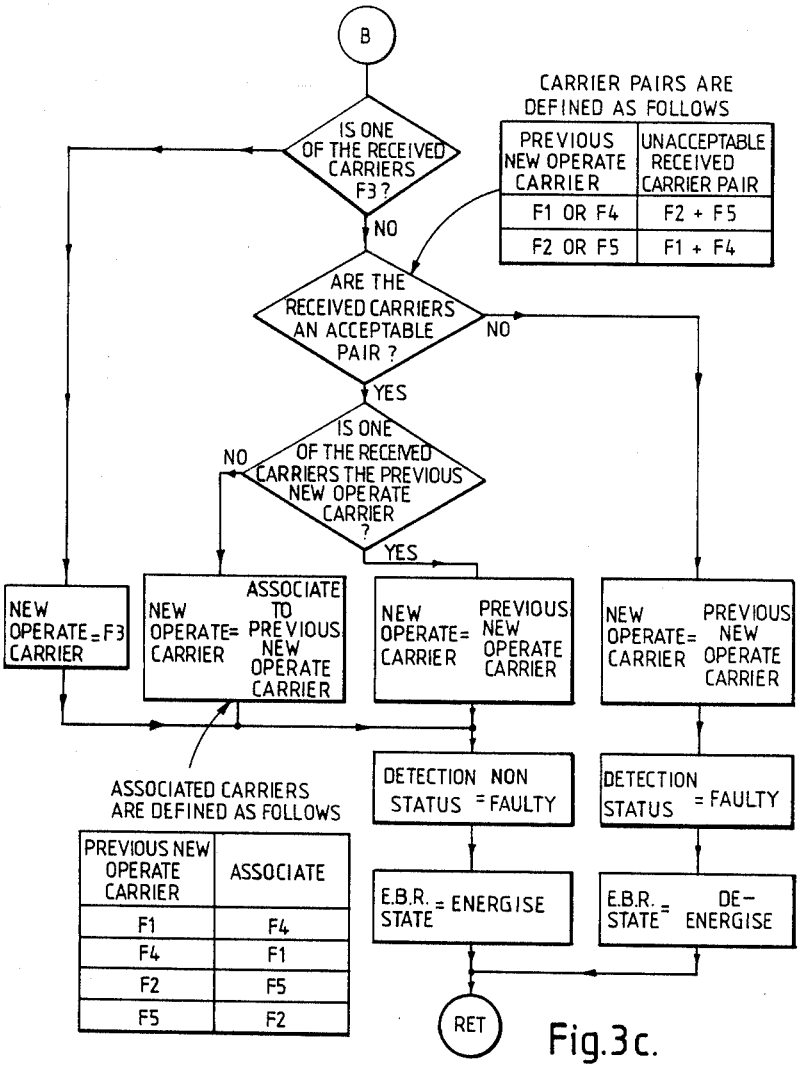
Figure 4:
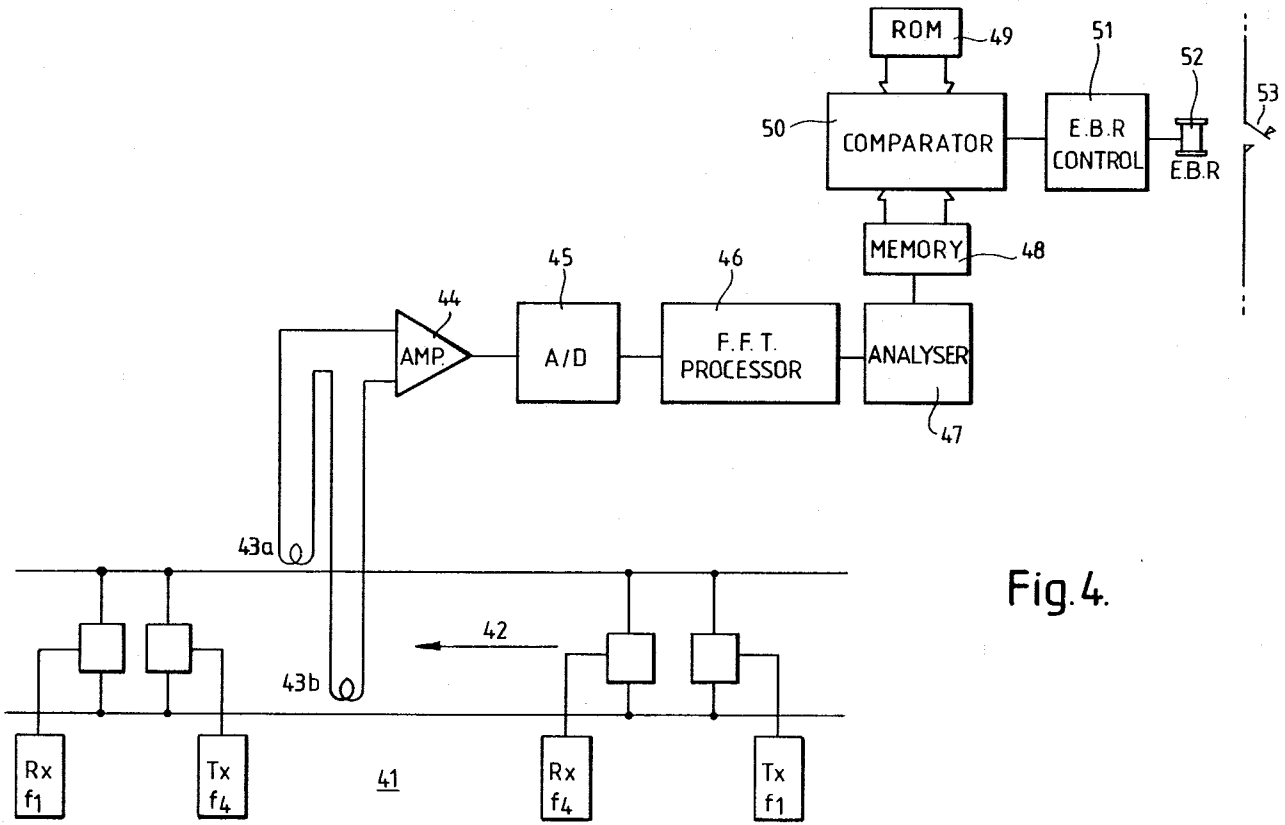

The invention and in particular one embodiment of the invention will now be described, by way of example only, with reference to the accompanying drawings, in which:

FIG. 1 illustrates one scheme for allocating five railway track circuit carrier frequencies, FIG. 2 illustrates the layout of signal loops in the vicinity of the cross-over of FIG. 1, FIGS. 3 (*a*), (*b*) and (*c*) show a flow chart outlining the logical decision paths of a vehicle borne receiver for use in the scheme illustrated in FIGS. 1 and 2, and FIG. 4 shows a block diagram of an ATP system employing the present invention.

Referring now to FIGS. 1 and 2 of the drawings there are shown two parallel railway tracks, labelled "up line" and "down line" in which the normal direction of travel of a railway vehicle is indicated case by an arrow. These two tracks are electrically divided into track circuits using jointless track sections by conventional means, except in the vicinity of a cross-over where special arrangements are employed as will be described below.

The track circuits are distinguished one from its adjacent neighbours by the use of different carrier frequencies upon which may be superimposed an automatic train protection signal (hereinafter referred to as an ATP signal). Five carrier frequencies are employed, as follows:

f1=4080 Hz
f2=4560 Hz
f3=5050 Hz
f4=5520 Hz
f5=6000 Hz

On the "up line", frequencies f1 and f4 are used in an alternating sequence, whilst on the "down line" frequencies f2 and f5 are used in a similar alternating sequence, and the fifth frequency f3 is reserved for use as a transfer frequency at the cross-over. This allocation of different frequencies to each of the tracks reduces electrical interference between the tracks and also increases the overall system safety.

In the ATP system being described, and to which the invention has been applied, the carriers are frequency shift keyed by ±40 Hz and the rate at which the frequency is shift keyed is a modulation rate comprising a coded representation of a safe maximum speed limit for the particular section of track. There are up to nineteen ATP code modulation rates available in all sections, plus one track circuit code generator modulation rate, which may lie within the frequency range of 28 Hz to 80 Hz, but the latter is not directly concerned with the present invention.

Referring now to FIG. 2 there is shown a track circuit arrangement of the ATP system in which each track circuit (TC) has an associated transmitter (TX), in the example being described located in a remote relay room, a tuning unit mounted in the "four foot" near the exit end of the section, a tuning unit also mounted in the "four foot" near the entrance end of the section and a track circuit receiver (RX) again located remotely in the relay room. The tuning units at the exit and entrance ends of the section match the output of the transmitter and the input of the receiver respectively to the impedance of the running rails of the section.

The selected carrier frequency for a track circuit is generated in the transmitter and is frequency shift keyed by a selected modulation code generator. This signal is then transmitted via the running rails of the section to the receiver, which is arranged to filter and check the carrier and sideband frequencies of a received signal and, assuming these checks are correct, then energize the track circuit relay. The track circuit relays of all the track circuit sections are therefore normally continuously energized and "picked-up" providing that a train is not present in any section, in which case the signal in that section is shorted by the leading vehicle, and thus prevented from reaching the receiver, which releases the track circuit relay to indicate presence of the train.

When there are no trains, either in or approaching a track section, the corresponding track circuit carries a signal which contains no coded information for the train's ATP system, but merely carries the basic track circuit signal to energize the track circuit relay. Since the ATP signal contains at least maximum speed limit information intended for one particular train only, the ATP signal is injected into the track circuit in the immediate vicinity of the location of a train. As a train approaches a track section the track circuit signal is changed to one carrying the required ATP coded signal.

When a train enters a track section it receives the ATP signal via signal pick-up means located ahead of the leading axle which, as is well known, shorts out the signal between the track circuit transmitter and receiver leading to the track circuit relay being de-energized to indicate the presence of the train.

In sections where trains may cross from one track or road to another, cross-overs, steps are taken to avoid putting an ATP signal onto the "wrong road". As shown in FIG. 2 for example, individual loops 10, 12 are laid in each of straight ahead route directions and a separate, third loop 14 is laid in the cross-over itself. The cross-over loop 14 overlaps the straight ahead loops 10 and 12 in those parts at either end of the cross-over section which are shared with the straight ahead routes.

The presence of a train in the track sections is detected conventionally by de-energization of track circuit relays normally picked-up by track circuit signals conducted by the rails between track circuit transmitters and receivers as is well known. The rails of the cross-over, lying between the two straight ahead routes, are insulated from the rails of the other sections by insulating block joints 16, 18 which effectively prevent cross-injection of signals from one road to the other via the running rails.

When a straight ahead route is set, the straight ahead loop 10 or 12 only is energized and carries the corresponding ATP signal in the correct carrier sequence allocation for the line. The cross-over loop 14 is not energized and carries no signal at all.

However, when a cross-over route is set, the cross-over loop 14 is energized and transmits the ATP coded signal superimposed on the carrier frequency allocated for cross-overs, that is frequency f3, and the straight ahead loops 10 and 12 are switched off and carry no signals at all.

The ATP equipment carried by the train includes signal pick-up means positioned at the front of the leading vehicle ahead of the foremost wheels, the output of which feeds the received signal into a receiver and then into a decoder. This decoder extracts the maximum speed signal and compares it with the measured speed of the train. If the actual speed is greater than the permitted maximum the emergency brake is brought into operation. The emergency brake may also be actuated in other circumstances, detected as being potentially dangerous to the safety of the train and its passengers, such as when no ATP signal is detected, or if two or more signals are received with sufficient amplitudes to prevent certain detection of the correct signal. With the arrangement of the system being described, in which an ATP signal is transmitted only in the vicinity of a train, the situation should not arise in which a train may receive two conflicting ATP signals but, should this arise, the train equipment may be arranged to permit the train to proceed at the lower of the detected maximum permitted speed limits.

The output of the decoder is connected to control operation of an emergency brake circuit, for example, by normally holding an emergency brake control relay in an energized state for as long as an ATP signal is received and is not exceeded by the measured train speed. If no such signal is received or is exceeded the control relay is immediately de-energized and the emergency brake accordingly actuated.

The decoder carried by the train includes means for identifying the carrier frequency and its modulation rate. As the train proceeds from section to section a sequence of carrier frequencies will be formed, and the decoder is provided with a temporary memory means in which is temporarily stored the detected sequence of carrier signals encountered by a moving train. There is also provided a permanent record of all possible such sequences, or at least those which may be encountered on a particular route to be travelled by the train, and means for comparing the contents of the temporary memory with the contents of the permanent memory to determine if the received sequence for the route of the train is a valid sequence.

It is preferred, in order to permit re-routing of a train, for example, to accommodate conflicting train movements, that the decoder is not prearranged to expect a particular sequence of carrier frequencies but to have a reset capability, which upon being activated operates to clear the temporary memory thus enabling a fresh sequence of carrier signals to be received and checked without either the train's progress being impeded or the emergency brake being brought into operation. The decoder includes means responsive to reception of the transfer frequency f3 to perform the reset function whenever a train runs over the loop 14 at a cross-over.

In operation of the described arrangement, consider a train travelling in the direction of the arrow on the "up line" in FIG. 1. In approaching the cross-over it will have encountered a sequence of frequencies in which f1 and f4 alternate. The "down line" will carry a sequence of alternating frequencies f2 and f5. On approaching the cross-over section and leaving the last section carrying frequency f4 the train encounters the cross-over section in which loop 14 carries a signal having frequency f3. Up to this time the train ATP decoder will have expected to continue encountering the sequence f1, f4 and would interprete any other received frequency not in that sequence as a potentially dangerous situation.

However, upon encountering frequency f3 the decoder is "reset" and the temporary memory containing the sequence f1 and f4 is erased, and prepared to receive a fresh sequence. Upon reaching the "down line" the train first encounters the frequency f2 and then f5, establishing a fresh sequence to which the decoder will now continue to respond until such time as it may encounter a further transfer frequency f3.

While the system described is fail-safe in operation, the present invention makes it possible to interpret accurately situations which arise through less than perfect operating conditions but which are not inherently unsafe, and so a train may be permitted to continue running in situations where otherwise it would be necessary to fail to safety.

The ATP equipment carried on the train continually seeks to prove a predetermined set of safe conditions and only if successful in this does it hold-off the emergency brake. Firstly, it is safe for a train to operate if ATP signals are received in a valid sequence for the route being travelled.

Second, the train may continue if a mixture of two ATP signals is received provided both are members of a valid sequence; if one of those received signals belongs to the valid sequence but the other does not the train may still continue but an alarm is raised. However, if both received signals do not belong to an already established valid sequence then the emergency brake is applied and the alarm warning issued.

Generally, any situation giving rise to more than two signals received simultaneously cannot be resolved safely. In such circumstances the train must be halted and the emergency brake is applied.

When the transfer brake frequency f3 is received the ATP equipment is "reset" and subsequently will respond normally to a fresh, or the same, valid sequence. However, if the equipment receives mixed frequencies from different sequences the emergency brake is brought into operation and an alarm initiated. Also, if the train has not previously received any ATP signal, for example because it has just emerged from a marshalling yard or depot, then it is receptive to the first encountered signal frequency to establish a new valid sequence. If two signals from the same sequence are detected, a mixed code alarm may be raised, but operation of the train is permitted. On the other hand if mixed signals from different sequences are encountered an unresolvable and unsafe condition is determined to be present and the emergency brake is operated.

In one embodiment of the invention the decisions outlined above are determined by a microprocessor with reference to the permitted and non-permitted combinations of signals stored in a memory in the equipment. The analysis of the received signals may be carried out by several alternative arrangements. One such suitable arrangement is described in the assignee's U.S. Pat. No. 4,516,249 in which there is disclosed a suitable railway signalling receiver incorporating a Fast Fourier Transform frequency spectrum analyser.

Referring now to FIG. 4 of the drawings there is shown, in schematic representation, an ATP system. The track is shown diagrammatically at 41 and the direction of motion of a train is indicated by arrow 42. The portion of track shown consists mainly of a track section carrying a track circuit signal at frequency f4, with further track sections on either side carrying a signal of frequency f1. The track circuit transmitters and receivers are indicated by blocks Tx and Rx respectively, suffixed by the frequency of the track circuit signal as appropriate.

The train (not shown) is provided with a pair of pick-up coils 43*a*, 43*b* mounted low down at the front of the leading vehicle, ahead of the front axle, one immediately above each of the track rails and in signal receiving relationship therewith. The coils 43*a*, 43*b* are connected to amplifying means generally indicated at 44. The construction of this amplifying means and of the equipment thus far described may be as well known and used in the prior art.

The output of amplifying means 44 is connected to the signal input of an analogue to digital sampling means 45 operated at a suitable sampling rate for accumulating real time series data samples which are supplied to a fast Fourier transform processor 46, of the type described in the assignee's U.S. Pat. No. 4,516,249. The output of processor 46 is connected to frequency spectrum analysing means 47 operatively responsive to the frequency domain output of processor 46 to execute the code analysing function described above. The processor output comprises a digital read-out of the amount of power calculated in each frequency element or frequency bin of the signal spectrum, calculated from the real time series data samples of the received signal provided by the sampling means 45. Analyzing means 47 comprises means responsive to the identification of the appropriate bins of the track circuit signal frequencies which it is possible for the train to encounter during its progress. At the moment depicted in the drawing the output of analyzing means 47 will indicate, assuming correct operation and no interference etc., that signal frequency f4 is present. It will previously have identified signal frequency f1, as it will do so again as the train moves leftwards in the drawing, followed by f4 again and then f1 and so on.

The sequence of identified frequencies f1, f4, f1 etc. is digitally stored in a memory 48 for comparison with a record of valid frequency sequences stored in read-only-memory or ROM49. This comparison is performed by a comparator 50 and thus may achieved by bit by bit comparison using suitable register means although, in practice it is found more convenient to employ a microprocessor for this decision making process using software incorporating the decision making rules described above and illustrated in FIGS. 3(*a*), (*b*) and (*c*).

The contents of memory 48 are therefore continuously added to and, the memory being of finite capacity, it can store only the most recent portion of a frequency sequence and as each newly detected member is added to the existing sequence the oldest member is erased. The minimum number of stored frequencies required to positively identify a valid sequence in the described example is three, no more than this need be stored, although a greater number may be desired for assurance.

The comparator 50 is required to provide no more than a Stop/Go output, in its simplest form, for operating an Emergency Brake Relay (E.B.R.) Control circuit 51, to which it is connected. Control circuit 51 provides energizing current for the emergency brake relay 52 (energized to hold open, de-energized to close) the contacts 53 of which are in series with the vehicle emergency brake circuit. If the relay 52 is de-energized the contacts 53 are released and close, "making" the emergency brake circuit and thereby bringing about a full emergency application of the train's brakes. As described above, under certain circumstances, i.e. when track circuit cross-talk exists, it may be required to permit the vehicle to proceed at reduced speed, in which case the E.B.R. control circuit 51 is conditional upon measured train speed not exceeding a predetermined maximum speed. An apparatus and technique for achieving this is already known in the art in connection with railway vehicle automatic train protection systems.

The frequency spectrum analysing means 47 is also responsive to detection of sufficient power in the frequency bin containing frequency f3 to erase the contents of memory 48 to permit a fresh frequency sequence to be accepted without causing application of the emergency brakes.

What is claimed is:

1. A vehicle protection system including a vehicle confined to move within said system, which said system comprises:

at least first and second pathways along which said vehicle can travel, multiple electronic circuit sections contiguously positioned along each of said pathways, each of said sections of said first and second pathways having associated therewith a transmission means which are operable for generating and transmitting a signal of a predetermined frequency, with all of said transmission means associated with said first pathway generating and transmitting frequencies in accordance with a first defined sequence of frequencies and all of said transmission means associated with said second pathway generating and transmitting frequencies in accordance with a second defined sequence of frequencies, with said first and second sequence of frequencies being distinguishable from each other;

a third pathway along which said vehicle can travel connected between said first and second pathways, one or more electronic circuit sections contiguously positioned along said third pathway, each of said sections of said third pathway having associated therewith a transmission means which are operable for generating and transmitting a signal of a predetermined frequency, with all of said transmission means associated with said third pathway generating and transmitting frequencies in accordance with a third defined sequence of frequencies, with said third defined sequence of frequencies being distinguishable from said first and second defined sequence of frequencies; and a signal receiver and control means carried by said vehicle for receiving said signals transmitted by said transmission means, said signal receiver and control means including a programable means for maintaining a list of said first, second and third defined sequences of frequencies and a means for comparing said sequence of frequencies being received from said transmission means with said list of said sequence of frequencies, with said receiver and control means further being operable for activating a safety function when said received sequence of frequencies is other than one of said sequence of frequencies of said list.

2. The system of claim 1 wherein said receiver and control means is further operable in response to receiving said third sequence of frequencies to operate said comparing means to compare a next received sequence of frequencies with those sequence of frequencies of said first and second sequences of frequencies to determine if said received sequence of frequencies is the same as either said first or second sequence of frequencies, and to operate said safety function if said output signal is not the same as one of said sequences of frequencies.

3. The system of claim 1 wherein the said first, second and third pathways comprise continuous railway tracks, said sections comprise railway track circuits and said first, second and third sequences of frequencies comprise railway track circuit carrier frequencies.

4. The system of claim 1 wherein said first and second sequence of frequencies are comprised of two distinct alternating frequencies, with said two distinct alternating sequence of frequencies comprising said first sequence of frequencies being distinguishable from said second sequence of frequencies, while said third sequence of frequencies is comprised of a further distinguishable frequency.

5. The system of claim 4 wherein said third sequence of frequencies is comprised of a single frequency distinguishable from said distinct frequencies of said first and second sequence of frequencies.

6. The system of claim 1 wherein said receiver and control means includes: means for sampling said received frequency signals and accumulating a series of data samples indicative of said received sequence of frequencies over a defined period of time; and wherein said sampling means is in communication with said programable means for transmitting said series of data samples to said programable means, and said programable means includes programs for performing a fast Fourier transform on said series of data samples for generating an output signal indicative of said received sequence of frequencies.

7. The system of claim 6 wherein said first and second sequence of frequencies are comprised of two distinct alternating sequence of frequencies, with said two distinct alternating sequence of frequencies comprising said first sequence of frequencies being distinguishable from said second sequence of frequencies, while said third sequence of frequencies is comprised of a further distinguishable frequency.

8. The system of claim 7 wherein said third sequence of frequencies is comprised of a single frequency distinguishable from said distinct frequencies of said first and second sequence of frequencies.

9. The system of claim 8 wherein said programable means includes; a first memory for storing said output signal indicative of said received sequence of frequencies received from said sampling means; a second memory for storing a plurality of comparison output signals indicative of each of said first, second and third sequence of frequencies; and wherein said receiver and control means further includes a comparing means which communicates with said programmable means and which compares said received output signal stored in said first memory with all of said comparison output signals stored in said second memory to determine if said received output signal is the same as one of said comparison output signals.

10. The system of claim 9 wherein said receiver and control means is further operable in response to receiving said third sequence of frequencies to operate said comparing means to compare a next received output signal indicative of said sequence of frequencies received from said sampling means with said comparison output signals indicative of each of said first, second and third sequence of frequencies to determine if said received output signal is the same as said comparison output signals indicative of either said first or second sequence of frequencies and to operate said safety function if said received output signal is not the same as one of said comparison output signals.

11. The system of claim 10 wherein the said receiver and control means will operate in responsive to receiving said third sequence of frequencies to clear said first memory for allowing an input of a new output signal indicative of said next received sequence of frequencies.

12. The system of claim 6 wherein said programable means includes: a first memory for storing said output signal indicative of said received sequence of frequencies; a second memory for storing a plurality of signals representative of each of said first, second and third sequence of frequencies which said receiver and control means should receive from any of said first, second or third pathway transmission means for a route along which said vehicle will travel; and wherein said receiver and control means further includes a comparing means which communicates with said programable means and which compares the contents of the said first and second memories to determine if said contents of said memories are the same or different.

13. The system of claim 12 wherein said receiver and control means is further operable in response to receiving said third sequence of frequencies to operate said programable means to select a next one of said sequence of frequencies of said list in accordance with said route of said pathways in which said vehicle is traveling for comparison with said received sequence of frequencies.

* * * * *